United States Patent [19]

Valenduc

[11] Patent Number: 4,961,980

[45] Date of Patent: Oct. 9, 1990

[54] PROCESS AND APPARATUS FOR THE MANUFACTURE OF FLOOR OR WALL COVERINGS INCORPORATING PEBBLES, AND THE PRODUCT OBTAINED THEREFROM

[75] Inventor: Gerard Valenduc, L-Wiltz, Luxembourg

[73] Assignee: Eurofloor, S.A., Luxembourg

[21] Appl. No.: 364,811

[22] Filed: Jul. 10, 1989

Related U.S. Application Data

[62] Division of Ser. No. 69,369, Jul. 1, 1987, Pat. No. 4,882,205.

[30] Foreign Application Priority Data

Jul. 8, 1986 [LU] Luxembourg ..... 86504

[51] Int. Cl.[5] ..... B05D 1/36

[52] U.S. Cl. ..... 428/67; 428/172

[58] Field of Search ..... 428/67, 172

[56] References Cited

U.S. PATENT DOCUMENTS

| | | | |
|---|---|---|---|
| 3,152,002 | 10/1964 | Wisotzky | 117/21 |
| 3,466,223 | 9/1969 | Beeler et al. | 161/162 |
| 3,584,096 | 6/1971 | Kassouni et al. | 264/112 |
| 3,749,629 | 7/1973 | Andrews et al. | 428/67 |
| 3,804,657 | 4/1974 | Eyman et al. | 427/203 |
| 4,212,691 | 7/1980 | Potosky et al. | 427/203 |
| 4,336,293 | 6/1982 | Eiden | 428/143 |
| 4,348,447 | 9/1982 | Miller et al. | 428/143 |
| 4,467,007 | 8/1984 | Elgie | 428/142 |
| 4,504,523 | 3/1985 | Miller et al. | 427/203 |
| 4,675,216 | 6/1987 | Du Forest et al. | 427/203 |

*Primary Examiner*—Shrive Beck

*Attorney, Agent, or Firm*—Fishman, Dionne & Cantor

[57] ABSTRACT

An apparatus and method for coating a substrate with plastisol and depositing pebbles into the ungelled coated plastisol is presented. A powder containing fusible particles compatible with the coated substrate and the pebbles is then deposited by at least one rotary silk-screen printing frame and thereafter a heat treatment is carried out in an oven or with infrared lamps at a temperature below the distortion temperature of the substrate in order to set the deposited materials.

11 Claims, 1 Drawing Sheet

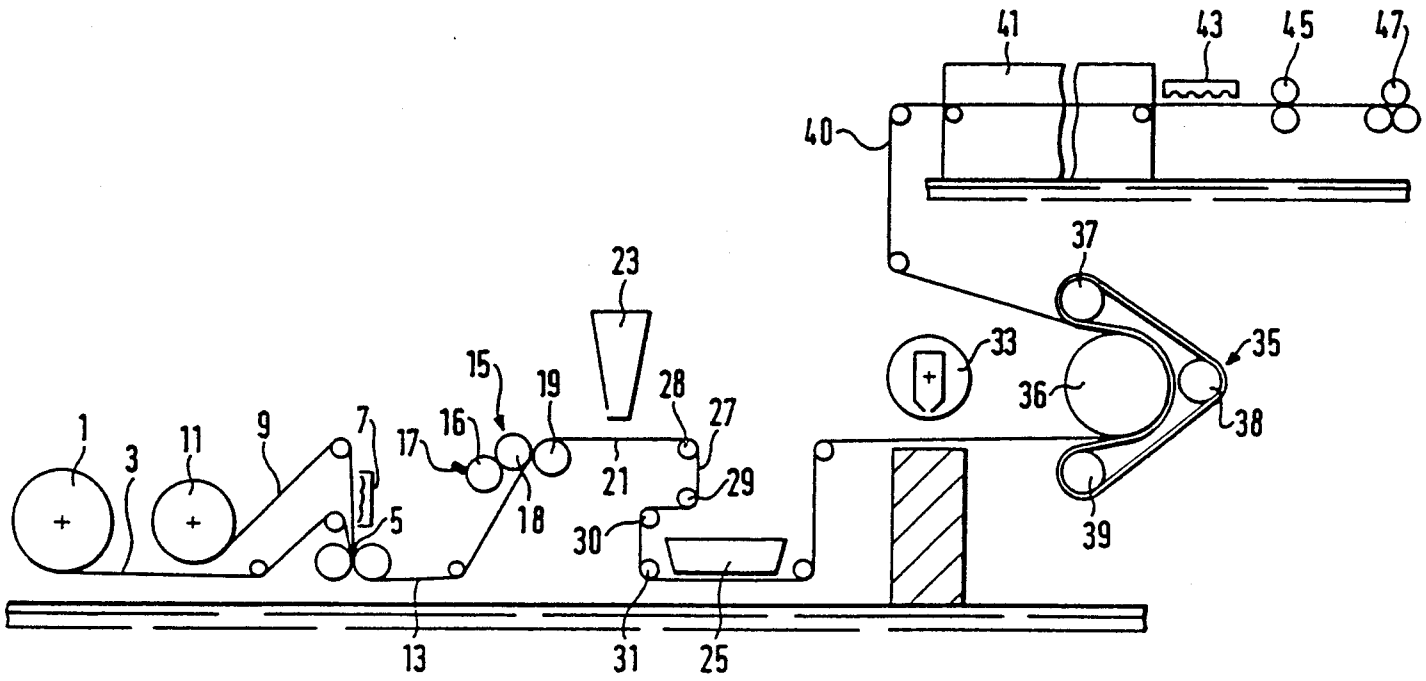
47
45
43
41
40
35
38
37
36
39
33
23
28
27
29
21
30
31
25
19
18
15
16
17
13
7
5
9
11
3
1

PROCESS AND APPARATUS FOR THE MANUFACTURE OF FLOOR OR WALL COVERINGS INCORPORATING PEBBLES, AND THE PRODUCT OBTAINED THEREFROM

This is a divisional of co-pending application Ser. No. 069,369 filed on July 1, 1987 now U.S. Pat. No. 4,882,205.

BACKGROUND OF THE INVENTION

The present invention relates to a process for the manufacture of floor and/or wall coverings. More particularly, this invention relates to a novel process for manufacturing floor and/or wall coverings incorporating an inclusion of material such as fragments of PVC or other materials compatible with the covering to be manufactured; such materials being generally referred to as "pebbles". The present invention also relates to a floor or wall covering produced by this process as well as an apparatus for manufacturing the novel floor and wall covering.

U.S. Pat. No. 4,467,007 discloses a process for the manufacture of a covering material for external use. An adhesive, onto which pebbles of different particle size are successively applied, is deposited on a web; the adhesive is dried, excess pebbles are removed and the product thus obtained is covered with a sealing product. However, in the covering described in U.S. Pat. No. 4,467,007, there is no smoothing by melting and the covering has an excessive roughness which permits the deposition and accumulation of dirt. It is therefore unsuitable as a floor covering, since the hollows between the pebbles are not filled in with a synthetic material; and since no compacting operation is provided at the end of the process. Moreover, this process makes it necessary to employ two successive heat treatment stages.

German Patent No. GB-A-938,411 relates to a covering having a mosaic surface appearance. This covering is produced from a process comprising the steps of deposition of mosaic components, spaced apart from one another onto a web. If desired, interposed between the web and the mosaic components is an adhesive consisting of an acrylic resin. This is followed by heat setting treatment and then deposition of a fusible PVC powder in the interstices enclosed between the various mosaic components in order to bind them to each other by melting of the resin powder. However, particularly in the case where they are employed as a floor covering which is subject to high stresses, these mosaic components run the risk of delaminating away from the wear layer, particularly because of the heterogeneous nature of the adhesive employed.

As in the process of U.S. Pat. No. 4,467,007, the technique of the German Patent also involves the use of two successive heat treatment stages. In the first stage, the mosaics are exposed, directly and without protection, to direct heating which runs the risk of causing partial melting of the corners or ridges of the mosaics, thus "rounding-off" their asperities, which results in a relatively undesirable aesthetic appearance.

U.S. Pat. No. 3,584,096 discloses a process for the manufacture of a synthetic film having the appearance of suede leather. However, this process is unsuitable for the manufacture of a floor covering incorporating inclusions of a fusible material and permitting a wide variety of decorative patterns.

U.S. Pat. No. 3,466,223 describes a process for the manufacture of a synthetic floor covering having good dirt resistance, comprising a relatively thick, flexible base layer including PVC granules and a dirt resistant upper layer. The various layers are obtained by deposition of PVC powders, the upper layer having a particular composition. However, this process is unsuitable for the manufacture of a floor covering permitting many variations in the development of the decorative pattern. Furthermore, it is fairly costly, because of the deposition of two successive and different layers of PVC powder.

U.S. Pat. Nos. 3,359,352, 3,239,364, 2,232,780, 4,212,691 and 3,754,065 disclose other processes for the manufacture of floor or wall coverings, also incorporating inclusions of materials The processes are nevertheless complicated, are generally not suitable for the use of "pebbles" which are not readily fusible and do not permit many variations in the decorative patterns produced.

SUMMARY OF THE INVENTION

The above discussed and other disadvantages and drawbacks of the prior art are overcome or alleviated by the present invention which provides a new process for the manufacture of floor or wall coverings having inclusions or "pebbles" therein, but which avoid the disadvantages of the prior art. The present invention provides a process for the manufacture of floor or wall coverings which is simple and low cost; and which permits numerous variations in the development of the decorative pattern to be obtained and which permits better heat distribution and lower heat usage.

In accordance with the present invention, a plastisol coating is deposited onto a substrate, known per se. Next, a plurality of discreet particles or "pebbles" are deposited in the ungelled coated plastisol layer. A powder containing fusible particles compatible with the substrate and the "pebbles" is then deposited; and a heat treatment is carried out at a temperature below the distortion temperature of the substrate, in order to set the deposited materials.

The above described and other features and advantages of the present invention will be appreciated and understood by those skilled in the art from the following detailed description and drawing.

BRIEF DESCRIPTION OF THE DRAWING

The single FIGURE is a schematic view of an apparatus for preparing a covering product in accordance with the present invention.

DESCRIPTION OF THE PREFERRED EMBODIMENT

The present invention relates to an apparatus and process for making synthetic covering products. Initially, a plastisol coating is deposited onto a conventional substrate. Thereafter, a plurality of discreet particles or "pebbles" are deposited into the ungelled plastisol coating. Next, a powder containing fusible particles compatible with the substrate and the "pebbles" is deposited followed by a heat treatment to set the deposited materials.

The term "plastisol" should be understood in its usual technical meaning, that is, as a suspension of PVC in a plasticizer without the addition of volatile constituents.

Since the pebbles themselves are, preferably, vinyl-based and usually consist of PVC, a product of homogeneous chemical nature is obtained, without the risk of the pebbles disengaging. The use of a fusible powder permits the plastisol to be gelled and the surface to be smoothed by melting of the fusible powder in a single heat treatment stage.

In a particularly preferred embodiment of the present invention, a compacting operation is performed on the pebbles after the deposition of powder. The compacting operation is preferably carried out between a roll and a pressing belt. In this manner, better filling of the voids, and consequently a denser product, is obtained. The use of the above mentioned apparatus in which the compressive force is directed substantially perpendicularly to the surface of the covering makes it possible to produce compacting without a preferred orientation of the particles.

The "pebbles" are preferably deposited in excess in the ungelled coated plastisol layer and the excess is removed, for example by gravity, blowing or any other method.

Preferably, the plastisol coating deposited on the substrate consists of a highly gelling plastisol based on copolymer and plasticizer. It is deposited more particularly in a thickness adapted to the particle size of the "pebbles" to be deposited.

In accordance with a preferred embodiment of the present invention, the "pebbles" consist of fragments of PVC, which can be obtained by grinding a PVC sheet.

The deposition of powder containing fusible materials, more particularly, an optionally colored PVC power, is preferably carried out with the aid of a silk screen printing frame, without contact between the substrate incorporating the various deposits of materials and the silk screen printing frame Advantageously, a silk screen printing frame of variable mesh can be employed, according to the technique described in the publication EP-A-0,121,748 or in U.S. Pat. No. 4,675,216, all of the contents of which are incorporated herein by reference. In this way, the powder can be deposited according to a density which can vary locally, without disturbing or dislodging the "pebbles" deposited beforehand. This technique permits a wide variety of decorations.

It should be noted that the decoration produced results from the combination of numerous parameters such as, for example:

- the thickness, tint, opacity and viscosity of the plastisol coating deposited on the substrate;
- the heat distortion characteristics, the particle size and the tint of the PVC fragments (pebbles), and,
- where appropriate of the mixture of fragments of different tints; and
- the quantity of powder deposited and its tint.

In order to extend further the possibilities of producing different decorations, the product obtained can be treated in various ways which are known per se. Thus, an embossing step may be provided after the final gelling, which is intended to provide the product obtained with a structured or embossed or smooth surface appearance.

It will be appreciated that because of the process of the present invention, which does not comprise an intermediate heating or other setting step, an individual floor or wall covering is obtained, providing considerable freedom insofar as the variations in the decorative pattern obtained are concerned.

It is surprising that, despite the absence of one or more intermediate setting steps, a filling powder can be deposited without disturbing the order of the pebbles and without detaching them. It is also surprising to find that a compacting of the "pebbles" can be performed despite a deposit of powder over the entire surface of the product being manufactured (also on the "pebbles"); and that after the compacting operation, the "pebbles" remain visible and the powder fills the interstices between the "pebbles"

Another unexpected effect obtained within the scope of the process of the present invention lies in the fact that the "pebbles" lodged under a fairly large deposit of powder have lessened deformation or crushing whereas the "pebbles" which are barely covered with powder have greater deformation. The appearance of the pebbles can also be varied by locally metering the powder deposit by means of a rotary silk-screen printing frame (cadre screen) with a variable mesh, while depositing the pebbles uniformly over the entire surface of the coating.

The present invention also relates to an apparatus for carrying out the process described hereinabove. This apparatus comprises at least one device for coating the substrate with a plastisol (for example, a device with coating rolls or with an air jet), a dispenser of "pebbles" consisting of a hopper, a device for recovering excess "pebbles" (for example, a vertical path of the substrate arranged above a collecting and recycling receptacle), at least one rotary silk-screen printing frame for depositing the powder without contact with the substrate, a compacting device and at least one means of setting such as an oven and/or infrared lamps.

In a particularly preferred embodiment, the compacting step is carried out on a machine of the "AUMA" type, in which the product is compacted between a roll which it partly encloses and an endless belt turning over three rollers and applying the product with pressure against the roll. The roll may be heated. Preferably, the setting oven is followed by a unit with infrared lamps and by an embossing roll whose temperature is adapted to optimize the embossing.

It will be appreciated that the above described apparatus includes, upstream, a substrate unwind and/or a system for preparing the substrate and, downstream, a winder for the product obtained thereby.

With reference to the figure, the apparatus of the present invention comprises an unwind mechanism 1 for a web 3 coated at 5, after heating at 7, with a size stabilizing component 9, such as a glass voile originating from an unwind mechanism 11. Substrate 13 is obtained in this manner. It will be appreciated that substrate 13 may also be prepared differently or in another apparatus, independent of the apparatus in accordance with the present invention and may, if desired, be stored in reeled form before being employed for the application of the present invention.

Substrate 13 then passes through a coating device 15, known per se, which consists of a first roll 16 equipped with a doctor blade 17 which applies the coating onto a coating roll 18 in contact with the substrate supported by a back-up roll 19. It will be appreciated that this device, known per se, may be replaced by any other suitable device, such as a coating blade or the like.

The coated substrate 21 then passes under a hopper 23 which permits pebbles to be deposited in excess. The deposition may be controlled by the opening of the hopper 23, as a function of the speed of travel of the coated substrate 21. The excess pebbles are recovered in a receptacle 25 arranged under a vertical path 27 of the loaded substrate, diverted over the rollers 28, 29, 30 and 31.

The loaded substrate 27 then travels under a silk screen printing roll 33, preferably with variable mesh, which enables a fusible powder to be deposited without contact with the loaded substrate.

Roll 33 is followed by a compacting device 35 which may consist of any device known per se. In the case of the figure, a compacting device 35 is shown, which comprises a heated roll 36 partly enclosed by the loaded substrate, the successive deposits being turned towards roll 36, and an endless belt turning over at least three rollers 37, 38 and 39, which ensure the pressure of the loaded substrate against the heated roll 36.

The loaded and compacted substrate 40 then passes through a setting oven 41 regulated at between 160° C. and 220° C. and passes under infrared lamps 43 in order to complete the setting of the successive deposits. An embossing device 45 and a winder device 47 may also be provided downstream.

EXAMPLE

The principal components which have the greatest effect on the decoration produced according to the present invention are the "pebbles" and the fusible synthetic powder.

The pebbles are, for example, preferably made from a calendered or extruded, ground and graded PVC sheet.

The K value and plasticizer content of the PVC formulation employed may be varied depending on the desired result, that is, a more or less pronounced crushing of the "pebbles" during the compacting and/or embossing.

The PVC formulation which follows is given only by way of example without implying any limitation.

An extruded or calendered sheet with a thickness of 2 mm is produced from the following composition, given in parts by weight:

| | |
|---|---|
| PVC homopolymer manufactured by suspension | 100 |
| Chalk | 100 |
| Phthalate-type plasticizer | 35 |
| Epoxidized soya oil | 3 |
| Titanium Oxide | 16 |
| Ba/Cd Stabilizer | 2 |
| Stearin | 0.20 |
| | 256.20 |

The sheet obtained in this manner is ground in two stages.

(a) pallman type PS 4-5FR3 6 mm screen, and (b) pallman type PS 4-5S9 2 mm screen.

The product obtained is then graded on a vibrating screen.

In an alternative form, the above mentioned composition may be pigmented. A homogeneous flamed sheet may also be produced.

It will be appreciated that the present invention is not limited to PVC "pebbles". It is also possible to use any other organic or mineral material as the included material.

The formulation of the fusible synthetic powder is as follows (parts by weight):

| | |
|---|---|
| PVC homopolymer prepared in bulk | 160 |
| Pthalate plasticizer | 56 |
| Tin stabilizer | 3.20 |

-continued

| | |
|---|---|
| Epoxidized soya oil | 4.80 |
| PVC manufactured by emulsion | 8.00 |

In this case, a translucent composition is involved; opacificers and other pigments may also be added thereto.

A highly gelling plastisol coating is deposited in a thickness on the order of 0.2 to 0.5 mm, according to the thickness of the "composite" layer to be produced and of the article size of the pebbles.

The composition of the coating deposited on a substrate of the glass voile type is as follows:

| | |
|---|---|
| PVC copolymer containing 5% of polyvinyl acetate | 100 |
| Phthalate plasticizer | 18 |
| Benzyl/butyl phthalate | 23 |
| Ba/Zn stabilizer | 3 |
| Viscosity regulator | 7 |

An excess of pebbles of the above mentioned formulation and particle size is then deposited.

The deposition of the fusible powder described is then performed by means of a rotary silk screen printing frame without contact and the substrate loaded in this manner is subjected to a compacting operation under pressure and at a temperature on the order of 120° to 170° so that there is no adhesion to the compacting roll and so that the surface homogenization is sufficient in order to subsequently gel in an oven at 200° C.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Synthetic covering product obtained from the process comprising the steps of:

depositing a layer of plastisol onto a substrate;

depositing a plurality of discrete particles into said plastisol layer;

depositing a powder containing fusible particles compatible with said plastisol coated substrate and said discrete particles, said powder being deposited onto said discrete particles and plastisol layer in an amount effective to provide a smooth outer surface to the synthetic covering product upon the melting of said fusible particles and said powder being deposited by powder deposition means wherein no contact occurs between said powder deposition means and said substrate or said deposited layers; and heating said powder material to melt said fusible particles and thereby provide a smooth outer surface to the synthetic covering product.

2. Product according to claim 1 including the step of:

compacting said discreet particles after the deposition of said powder layer.

3. Product according to claim 2 wherein:

said compacting step is carried out at a temperature such that adhesion is precluded and such that surface homogenization is sufficient.

4. Product according to claim 3 wherein:

said compacting step temperature is between about 120° C. and about 170°.

5. Product according to claim 1 wherein:
said plastisol is deposited in a thickness adapted to the particle size of said discreet particles to be deposited.

6. Product according to claim 1 wherein:
said discreet particles are deposited in excess in the ungelled coated plastisol layer and wherein the excess is then removed.

7. Product according to claim 1 wherein:
said discreet particles comprise fragments of PVC.

8. Product according to claim 1 wherein
said powder is deposited by means of a rotary silk screen printing frame without contact between said substrate and said deposits of material and said silk-screen printing frame.

9. Product according to claim 1 wherein said heat treatment comprises:
a setting operation at a temperature of between 160° and 220° C.

10. Product according to claim 1 including the step of:
at least one surface treatment.

11. Product according to claim 10 wherein said surface treatment step comprises:
embossing said deposited layers.

* * * * *